US011473888B2

(12) United States Patent
Lafortune

(10) Patent No.: US 11,473,888 B2
(45) Date of Patent: Oct. 18, 2022

(54) SPOTTER AMMUNITION PROJECTILE AND METHOD FOR MAKING THE SAME

(71) Applicant: General Dynamics OTS—Canada Inc., Repentigny (CA)

(72) Inventor: Eric Lafortune, Repentigny (CA)

(73) Assignee: General Dynamics OTS—Canada Inc., Repentigny (CA)

( * ) Notice: Subject to any disclaimer, the term of this patent is extended or adjusted under 35 U.S.C. 154(b) by 143 days.

(21) Appl. No.: 16/947,942

(22) Filed: Aug. 25, 2020

(65) Prior Publication Data

US 2022/0065598 A1 Mar. 3, 2022

(51) Int. Cl.

| | |
|---|---|
| ***F42B 12/40*** | (2006.01) |
| ***F42B 12/38*** | (2006.01) |
| ***F42B 5/02*** | (2006.01) |
| ***F42B 33/00*** | (2006.01) |
| ***F42B 8/12*** | (2006.01) |
| ***F42B 8/02*** | (2006.01) |

(52) U.S. Cl.

CPC ..... *F42B 12/40* (2013.01); *F42B 5/02* (2013.01); *F42B 8/02* (2013.01); *F42B 8/12* (2013.01); *F42B 12/38* (2013.01); *F42B 33/001* (2013.01)

(58) Field of Classification Search

CPC .... F42B 5/02; F42B 5/145; F42B 8/02; F42B 8/12; F42B 8/14; F42B 8/16; F42B 12/36; F42B 12/38; F42B 12/40; F42B 12/42; F42B 33/00; F42B 33/001

USPC ..... 102/439, 513

See application file for complete search history.

(56) References Cited

U.S. PATENT DOCUMENTS 2,409,380 A * 10/1946 Nichols ..... F42B 12/40 102/513
3,156,187 A * 11/1964 Baton ..... F42B 12/40 102/498
4,208,968 A * 6/1980 Hubsch ..... F42B 8/12 102/513
5,267,014 A 11/1993 Prenninger
(Continued)

FOREIGN PATENT DOCUMENTS

WO WO-2022040779 A1 * 3/2022 ..... F42B 12/38

OTHER PUBLICATIONS

International Search Report in PCT/CA2021/051122 (Year: 2021).*
Written Opinion of the International Searching Authority on PCT/CA2021/051122 (Year: 2021).*

*Primary Examiner* — James S Bergin
(74) *Attorney, Agent, or Firm* — LKGlobal | Lorenz & Kopf, LLP

(57) ABSTRACT

Spotter ammunition projectiles adapted to be fired from a firearm, methods for making spotter ammunition projectiles, and spotter ammunition cartridges including spotter ammunition projectiles are provided. In one example, a spotter ammunition projectile includes a projectile body section extending in a distal direction to a body distal end portion. A projectile ogive is coupled to the body distal end portion and has an outer ogive surface that tapers in the distal direction towards a shoulder. The projectile ogive includes a post that is disposed adjacent to the shoulder and that extends therefrom in the distal direction. An ogive nose cap is disposed adjacent to the shoulder and covers the post. The post and the ogive nose cap are cooperatively configured to define a cavity therebetween. A pyrotechnic spotter composition is disposed in the cavity.

20 Claims, 6 Drawing Sheets

(56) References Cited

U.S. PATENT DOCUMENTS

| | | | | |
|---|---|---|---|---|
| 5,654,524 | A * | 8/1997 | Saxby | F42B 12/40 102/513 |
| 6,097,491 | A | 8/2000 | Hartrumpf | |
| 6,139,323 | A | 10/2000 | Christians | |
| 6,808,467 | B2 | 10/2004 | Kojima et al. | |
| 8,074,555 | B1 | 12/2011 | Budricks et al. | |
| 8,168,804 | B2 | 5/2012 | Gore et al. | |
| 8,567,964 | B2 | 10/2013 | Mullen | |
| 8,881,655 | B2 * | 11/2014 | Aw | F42B 12/40 102/512 |
| 9,157,715 | B1 * | 10/2015 | Lafortune | F42B 12/40 |
| 9,217,627 | B2 * | 12/2015 | Sullivan | F42B 12/40 |
| 9,958,242 | B2 * | 5/2018 | Sullivan | F42B 12/50 |
| 10,527,393 | B1 * | 1/2020 | Sapp | F42B 12/62 |
| 10,845,172 | B2 * | 11/2020 | Moreno | F42B 8/16 |
| 11,287,235 | B2 * | 3/2022 | Lafortune | F42B 12/40 |
| 2017/0045346 | A1 * | 2/2017 | Aw | F42B 12/40 |
| 2017/0138710 | A1 | 5/2017 | Sullivan | |

* cited by examiner

SPOTTER AMMUNITION PROJECTILE AND METHOD FOR MAKING THE SAME

TECHNICAL FIELD

The technical field relates generally to ammunition for firearms, and more particularly, relates to spotter ammunition projectiles that are adapted to be fired from a firearm and that includes a pyrotechnic spotter composition for providing a bright light flash when impacting a target, and methods for making such spotter ammunition projectiles.

BACKGROUND

Target spotting cartridges including spotter projectiles that are fired from a firearm have been used for many years with different objectives. For training purposes, spotter projectiles are typically used to confirm a positive target hit through a bright light flash visible without the use of optical tools at a defined range. Spotter projectiles may also be used for training purposes to simulate visual effects of air burst and ground burst munitions.

Spotter projectiles have been produced for many small caliber ammunition, and some for medium and/or large caliber ammunition. Typically, small caliber spotter projectiles include a pyrotechnic spotter composition that is in the nose of the projectile compressed between a bullet steel core and a copper jacket and that ignites upon impacting a solid target. Typically, medium and/or large caliber spotter projectiles include a relatively large cavity in the projectile ogive filled with a compressed pyrotechnic spotter composition that ignites upon impacting a solid target.

Further, some target spotter projectiles include a percussion primer positioned at the projectile nose tip, used to ignite the pyrotechnic spotter composition upon impact with a solid target. However, such spotter projectile configurations may pose safety issues during transport and handling of the ammunition due to the percussion primer, which is sensitive to impacts.

For training purposes with spotter projectiles on thin steel targets, for example steel plate targets less than or equal to about 3 mm thick, the projectile ogive nose must be configured with a very thin wall to enable heating, igniting and releasing the pyrotechnic spotter composition before going through the target. If the pyrotechnic spotter composition is carried through the target before its ignition and combustion, there will be no apparent visible light flash in front of the target and the gunner crew will not be able to confirm a positive hit. To ensure an intense and rapid spotter flash that is clearly visible in daylight, the powdered pyrotechnic spotter composition must be compressed into the projectile ogive nose to an adequate density relative to the specific pyrotechnic composition type used.

By scale, a medium and/or large caliber projectile with a thin walled ogive results in a voluminous spotter cavity that requires significant amounts of compacted pyrotechnic spotter composition to fill the cavity. Unfortunately, the use of a relatively large pyrotechnic spotter composition charge, upon impact with a hard target, causes a huge flash with significant hot particle projections that increase the risk of causing a brush fire on the training range. Further, the use of a relatively large pyrotechnic spotter composition charges in spotter projectiles can prematurely damage the target and/or its infrastructure. An ammunition having a relatively high risk of causing fire incidents on the training range can have its use significantly restricted by the range control, local laws and regulations. Consequently, for medium and/or large caliber ammunition, for use on relatively thin steel plate targets, there is an unmet need to have a highly responsive and visible target spotter using only a small quantity of pyrotechnic spotter composition.

Further, most medium and/or large caliber spotter projectiles require at least three operations to assemble the spotter ogive, such as introducing the pyrotechnic powder to the spotter nose cap, pressing the pyrotechnic powder in the spotter nose cap, and final assembly of the spotter nose cap and components. This is inefficient and further manufacturing improvements are desirable.

As mentioned above, small caliber spotter projectile configuration typically involve pyrotechnic spotter compositions compressed in the projectile nose between the steel core and the copper jacket. However, copper has relatively low pyrophoric behavior, its particles do not easily ignite and burn, and consequently, when a spotter projectile with a copper jacket strikes a relatively thin steel target (e.g., less than or equal to about 3 mm thick), the pyrotechnic spotter composition may not always ignite before the projectile passes through the thin steel plate. Hence there will be no apparent visible flash in front of the target. Typically, such spotter projectiles require thicker steel targets to ensure reliability of the visible flash in front of the plate.

Upon impact with a relatively thin soft steel plate that may be positioned at varying angles, the ogive spotter configuration of the projectile has a very thin wall to enable rapid heating, bursting, igniting, and releasing of the pyrotechnic spotter composition in front of the target before the projectile passes through. Unfortunately, if the length of the thin wall is not carefully limited, the projectile may not be sufficiently robust to survive regular handling, weapon feeding, projectile launch and flight. Typically, most medium and/or large caliber spotter ogive have thicker wall configuration, and unfortunately do not always ignite in front of relatively thin steel targets.

Additionally, with poor storage conditions and/or in use, the pyrotechnic spotter composition in the projectile ogive can be negatively affected by exposure to humidity and rain. Unfortunately, when the pyrotechnic spotter composition is infiltrated by humidity, this will adversely affect the ignition reliability and flash intensity.

Accordingly, it is desirable to provide to spotter ammunition projectiles and methods for making spotter ammunition projectiles that address one or more of the foregoing concerns. Furthermore, other desirable features and characteristics of the various embodiments described herein will become apparent from the subsequent detailed description and the appended claims, taken in conjunction with the accompanying drawings and this background.

SUMMARY

Spotter ammunition projectiles adapted to be fired from a firearm, methods for making such spotter ammunition projectiles, and spotter ammunition cartridges adapted to be chambered in a firearm are provided herein. In an exemplary embodiment, the spotter ammunition projectile includes a projectile body section having a generally cylindrical shape extending in a distal direction about a longitudinal axis to a body distal end portion. A projectile ogive is coupled to the body distal end portion and has an outer ogive surface that tapers in the distal direction towards a shoulder that is disposed about the longitudinal axis. The projectile ogive includes a post that is disposed adjacent to the shoulder and that extends therefrom along the longitudinal axis in the distal direction to a post distal end portion. An ogive nose cap is disposed adjacent to the shoulder and has a wall that extends therefrom in the distal direction covering the post. The wall has an inner nose cap surface that faces towards the post and an outer nose cap surface that is disposed on a side opposite the inner nose cap surface and that tapers in the distal direction towards the longitudinal axis. The post and the ogive nose cap are cooperatively configured to define a cavity between at least a portion of the post and the inner nose cap surface. A pyrotechnic spotter composition is disposed in the cavity.

In an exemplary embodiment, the spotter ammunition cartridge includes a cartridge case including a generally cylindrical shell having a shell wall that surrounds an internal volume and that extends in a distal direction about a longitudinal axis to a case mouth portion. A spotter ammunition projectile includes a projectile body section that is disposed in the case mouth portion and that has a generally cylindrical shape extending in the distal direction about the longitudinal axis to a body distal end portion. A projectile ogive is coupled to the body distal end portion and has an outer ogive surface that tapers in the distal direction towards a shoulder that is disposed about the longitudinal axis. The projectile ogive includes a post that is disposed adjacent to the shoulder and that extends therefrom along the longitudinal axis in the distal direction to a post distal end portion. An ogive nose cap is disposed adjacent to the shoulder and has a wall that extends therefrom in the distal direction covering the post. The wall has an inner nose cap surface that faces towards the post and an outer nose cap surface that is disposed on a side opposite the inner nose cap surface and that tapers in the distal direction towards the longitudinal axis. The post and the ogive nose cap are cooperatively configured to define a cavity between at least a portion of the post and the inner nose cap surface. A pyrotechnic spotter composition is disposed in the cavity. A propellant is disposed in the internal volume and is ignitable to propel the spotter ammunition projectile from the case mouth in the distal direction.

In an exemplary embodiment, the method includes obtaining a projectile body section and a projectile ogive. The projectile body section has a generally cylindrical shape extending in a distal direction about a longitudinal axis to a body distal end portion. The projectile ogive is configured to couple to a body distal end portion and has an outer ogive surface that tapers in the distal direction towards a shoulder that is disposed about the longitudinal axis. The projectile ogive includes a post disposed adjacent to the shoulder and extends therefrom along the longitudinal axis in the distal direction to a post distal end portion. A pyrotechnic spotter composition is deposited adjacent to an inner nose cap surface of a wall of an ogive nose cap. The ogive nose cap is disposed adjacent to the shoulder such that the wall covers the post and the inner nose cap surface faces towards the post. The wall has an outer nose cap surface that is disposed on a side opposite the inner nose cap surface and that tapers in the distal direction towards the longitudinal axis. The post and the ogive nose cap are cooperatively configured to define a cavity between at least a portion of the post and the inner nose cap surface. The pyrotechnic spotter composition is disposed in the cavity.

BRIEF DESCRIPTION OF THE DRAWINGS

The various embodiments will hereinafter be described in conjunction with the following drawing figures, wherein like numerals denote like elements, and wherein.

DETAILED DESCRIPTION

Figure 1:
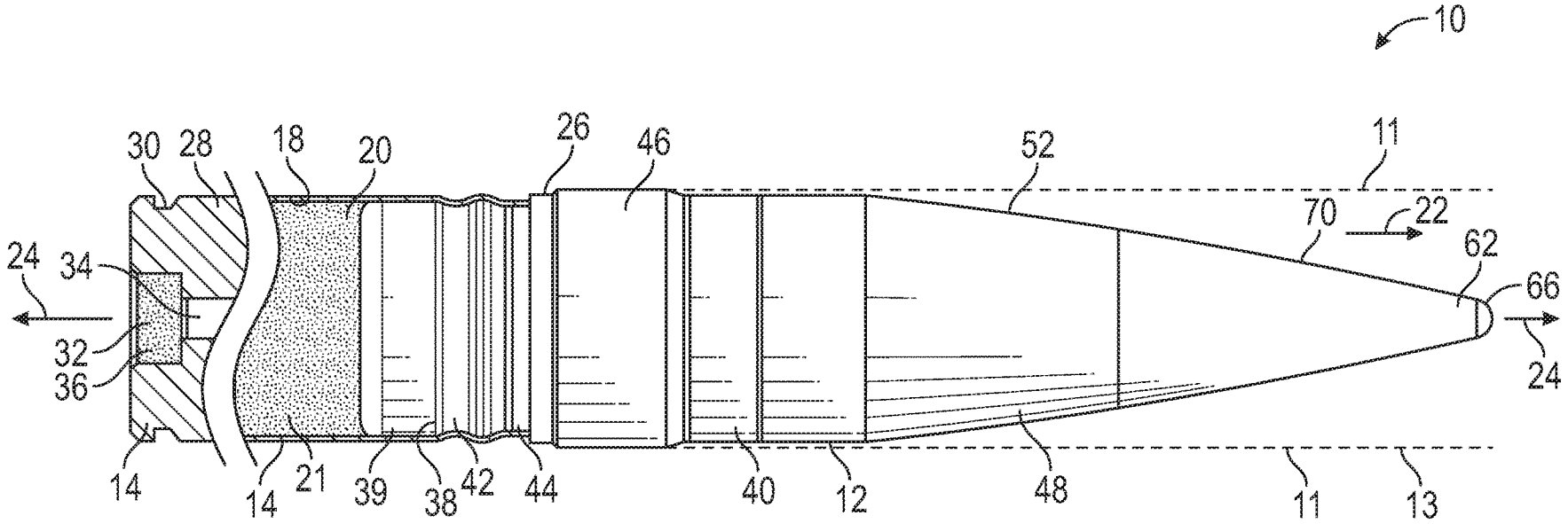
FIG. 1 illustrates a side view of a portion of a spotter ammunition cartridge including a spotter ammunition projectile in accordance with an exemplary embodiment.

The following Detailed Description is merely exemplary in nature and is not intended to limit the various embodiments or the application and uses thereof. Furthermore, there is no intention to be bound by any theory presented in the preceding background or the following detailed description.

Various embodiments contemplated herein relate to spotter ammunition projectiles and methods for making spotter ammunition projectiles. The exemplary embodiments taught herein provide a spotter ammunition projectile adapted to be fired from a firearm. The spotter ammunition projectile includes a projectile body section having a generally cylindrical shape extending in a distal direction about a longitudinal axis to a body distal end portion.

A projectile ogive is coupled to the body distal end portion. As used herein, the term "ogive" is understood to mean an object having a tapered 3-D end portion, for example a substantially linear, slightly rounded and/or rounded 3-D tapered end portion. In an exemplary embodiment, the projectile ogive has an outer ogive surface that tapers in the distal direction towards a shoulder that is disposed about the longitudinal axis. The projectile ogive includes a post that is disposed adjacent to the shoulder defining a shouldered post configuration and that extends therefrom along the longitudinal axis in the distal direction to a post distal end portion.

An ogive nose cap is disposed adjacent to the shoulder and has a wall that extends therefrom in the distal direction covering the post. The wall has an inner nose cap surface that faces towards the post and an outer nose cap surface that is disposed on a side opposite the inner nose cap surface and that tapers in the distal direction towards the longitudinal axis. The post and the ogive nose cap are cooperatively configured to define a cavity between at least a portion of the post and the inner nose cap surface. A pyrotechnic spotter composition is disposed in the cavity.

In an exemplary embodiment, the spotter ammunition projectile may be sized or otherwise configured as a small, medium, or large caliber spotter projectile. In an exemplary embodiment, advantageously the spotter ammunition projectile uses only a relatively small amount (e.g., about 1.5 gram (g) or less) of pyrotechnic spotter composition that provides a bright light flash, which is visible from about 1000 meters (m) to about 1500 m or further in daylight condition without optical tools, when impacting a relatively thin steel target (e.g., less than or about 3 mm thick). In one example, the pyrotechnic spotter composition is present in the cavity in an amount of about 0.5 g or less. In another example, the pyrotechnic spotter composition is present in the cavity in an amount of from about 0.5 g to about 1.5 g. In yet another example, the pyrotechnic spotter composition is present in the cavity in an amount of about 1.5 g to provide a bright light flash that is visible up to about 1500 m or further in daylight conditions without optical tools, when impacting a relatively thin steel target. In another example, the pyrotechnic spotter composition is present in the cavity in an amount of about 1 g to provide a bright light flash that is visible up to about 1000 m in daylight conditions without optical tools, when impacting a relatively thin steel target.

In an exemplary embodiment and as will be discussed in further detail below, advantageously the shouldered post configuration enables compressing the pyrotechnic spotter composition in the cavity while assembling the projectile ogive and ogive nose cap together in one operation. Advantageously, this allows for efficient assembly of the spotter ogive with a compressed pyrotechnic spotter composition disposed therein.

Further, in an exemplary embodiment, the ogive nose cap is made of a metal with good pyrophoric behavior, its particles easily ignite and burn, for example, aluminum, magnesium or titanium. Additionally, in an exemplary embodiment, the ogive nose cap has a relatively short, thin wall section that is adjacent to the pyrotechnic spotter composition and that is less than the diameter of the projectile body section. In one example, the thin wall section of the ogive nose cap has a length of less than about 50% of a medium caliber projectile diameter (e.g., less than about 50% of 30 mm, such as less than about 50% of 25 mm, for example, less than about 50% of 20 mm) and a minimum thickness of about 0.76 mm (e.g., 0.030 inches) to ensure sufficient structural strength for handling, weapon feeding and projectile launch and flight (e.g., firing). As such, advantageously when the spotter ammunition projectile impacts a relatively thin steel plate, for example at a relatively high velocity of about Mach 1, the ogive nose cap rapidly deforms and bursts, causing intense heating and sparking to occur and thereby reliably igniting the pyrotechnic spotter composition in front of the target before the spotter ammunition projectile passes through the target.

Additionally, in an exemplary embodiment, the spotter ammunition projectile includes one of an O-ring or lacquer that sealingly interfaces between the shoulder of the projectile ogive and the ogive nose cap. Advantageously, this ensures that the pyrotechnic spotter composition is fully sealed from potential humid storage conditions for reliable ignition and flash intensity.

Figure 2:
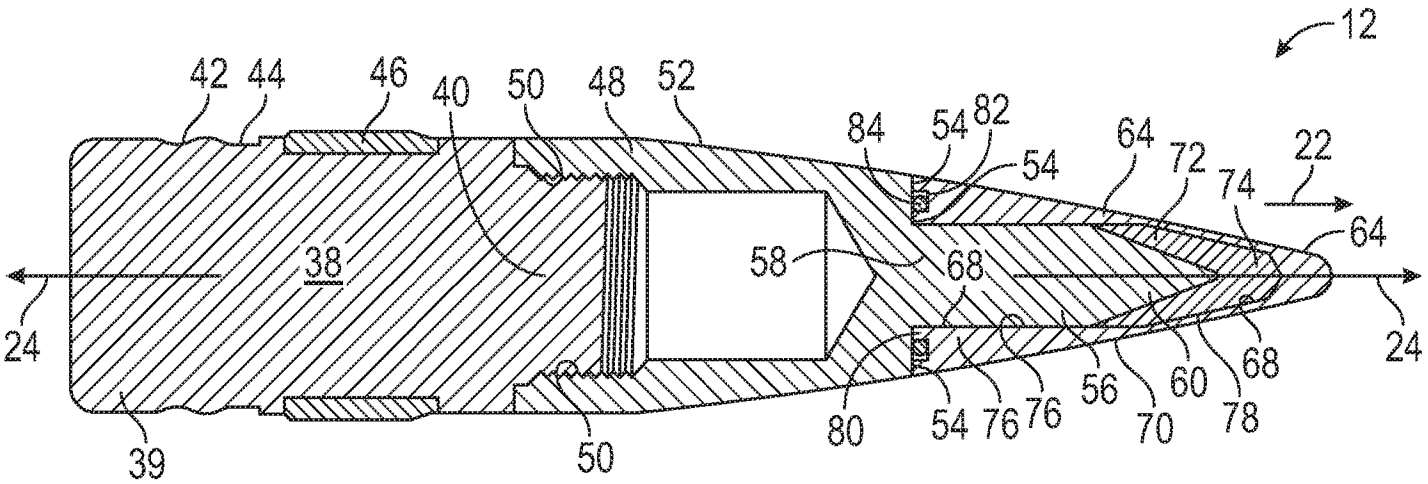
FIG. 2 illustrates a cross-sectional view of a spotter ammunition projectile in accordance with an exemplary embodiment.

FIG. 1 is a side view of a portion of a spotter ammunition cartridge 10 including a spotter ammunition projectile 12 in accordance with an exemplary embodiment. FIG. 2 is a cross-sectional view of the spotter ammunition projectile 12 depicted in FIG. 1. As illustrated, the cartridge 10 adapted to be chambered in a firearm 11 having a barrel 13 and includes a cartridge case 14. The cartridge case 14 includes a generally cylindrical shell 16 having a shell wall 18 that shell wall 18 surrounds an internal volume 20 containing a propellant 21. The shell wall 18 extends in a distal direction 22 about a longitudinal axis 24 to a case mouth portion 26 that is sized or otherwise configured to hold the spotter ammunition projectile 12.

At a proximal end portion 28 of the cartridge case 14 is an annular extraction groove 30, a primer pocket 32, a flash hole 34 for providing fluid communication between the primer pocket 32 and the internal volume 20. A primer 36 is disposed in the primer pocket 32. The primer 36 is ignitable when the firearm 11 is fired to ignite the propellant 21 to produce a propellant gas that drives the spotter ammunition projectile 12 from the case mouth portion 26 through the barrel 13 of the firearm 11 in the distal direction 22.

The spotter ammunition projectile 12 may be a small caliber projectile, a medium caliber projectile, or a large caliber projectile. In an exemplary embodiment, the spotter ammunition projectile 12 is a medium caliber projectile. Non-limiting examples of medium caliber projectiles include 20 mm caliber projectiles, 25 mm caliber projectiles, 30 mm caliber projectiles, 35 mm caliber projectiles, and 40 mm caliber projectiles. In an exemplary embodiment, the spotter ammunition projectile 12 is a large caliber projectile. Non-limiting examples of large caliber projectiles include 57 mm caliber projectiles, 76 mm caliber projectiles, 105 mm caliber projectiles, 120 mm caliber projectiles, and 155 mm caliber projectiles.

As illustrated, the spotter ammunition projectile 12 includes a projectile body section 38 that is disposed in the case mouth portion 26. The projectile body section 38 has a generally cylindrical shape extending in the distal direction 22 about the longitudinal axis 24 from a body proximal end portion 39 to a body distal end portion 40. Disposed between the body proximal end portion 39 and the body distal end portion 40 are annular grooves 42 and 44 and a driving band 46. The driving band 46 obturate the propellant gazes and transmits the rotation and/or facilitates stable travel of the spotter ammunition projectile 12 through the barrel 13 when the firearm 11 is fired. The driving band 46 may be integrally formed and therefore part of the projectile body section 38, or alternatively, may be a separate component that is disposed about and coupled to the projectile body section 38.

In an exemplary embodiment, a projectile ogive 48 is fastened to (e.g., via threaded engagement 50 or the like) or otherwise couple to the body distal end portion 40. As illustrated, the projectile ogive 48 has an outer ogive surface 52 that tapers in the distal direction 22 towards a shoulder 54 that is disposed about the longitudinal axis 24. In an exemplary embodiment, the shoulder 54 is an annular shoulder that is disposed around and spaced apart from the longitudinal axis 24.

The projectile ogive 48 includes a post 56 that is disposed adjacent to the shoulder 54. The post 56 extends along the longitudinal axis 24 in the distal direction 22 from a post proximal end portion 58 to a post distal end portion 60 that is disposed opposite the post proximal end portion 58. As illustrated, the annular shoulder 54 extends radially outward from a proximal-most end of the post proximal end portion 58. In one example, the post distal end portion 60 is configured as a conical end portion. In one example, the post 56 has a length of about 75% of the nose cap length or can be made shorter to introduce more pyrotechnic spotter composition as required. In an exemplary embodiment, the nose cap length must be sufficient to engage an adequate press fit with the post 56 and have enough internal volume for the deposited spotter bulk power, before compression.

In an exemplary embodiment, an ogive nose cap 62 is disposed adjacent to the shoulder 54 and has a wall 64 (e.g., conical wall or the like) that extends in the distal direction 22 from adjacent to the shoulder 54 to a tip end portion 66 to cover the post 56. As illustrated, the wall 64 of the ogive nose cap 62 has an inner nose cap surface 68 that faces towards the post 56 and an outer nose cap surface 70 that is disposed on a side opposite the inner nose cap surface 68. The outer nose cap surface 70 tapers in the distal direction 22 towards the longitudinal axis 24 to the tip end portion 66. In an exemplary embodiment, the ogive nose cap 62 is formed of aluminum or an aluminum alloy, magnesium or a magnesium alloy, titanium or a titanium alloy. In one example, the ogive nose cap 62 is formed of aluminum or an aluminum alloy.

In an exemplary embodiment, the post 56 and the ogive nose cap 62 are cooperatively configured to define a cavity 72 between at least a portion of the post 56 and the inner nose cap surface 68. As illustrated, the cavity 72 is disposed between the post distal end portion 60 and the inner nose cap surface 68.

A pyrotechnic spotter composition 74 is disposed in the cavity 72. The pyrotechnic spotter composition 74 provides a bright light flash when the spotter ammunition projectile 12 hits a target. As will be discussed in further detail below, the pyrotechnic spotter composition 74 is in a form of a compressed powder. In an exemplary embodiment, the pyrotechnic spotter composition 74 is a magnesium-based powder composition including magnesium, an accelerant to accelerate combustion of the magnesium, and a binder. In one example, the pyrotechnic spotter composition 74 includes magnesium powder, providing the flash, present in an amount of about 60 wt. %, potassium nitrate, accelerating the combustion, present in an amount of about 35 wt. %, along with a powder binder present in an amount of about 5 wt. %, based on the total weight of the pyrotechnic spotter composition 74. Alternatively, the pyrotechnic spotter composition 74 may be any other pyrotechnic spotter composition known to those of skill in the art. In an exemplary embodiment, the pyrotechnic spotter composition 74 is present in the cavity 72 in an amount of from about 0.5 g to about 1.5 g.

In an exemplary embodiment, to ensure that the ogive nose cap 62 rapidly deforms when impacting a target to reliably ignite the pyrotechnic spotter composition 74 in front of the target, and yet to have sufficient structural integrity for handling, firing, and the like, the wall 64 of the ogive nose cap 62 defines a conical-shaped nose cap having a thick wall section 76 and a thin wall section 78. The thin wall section 78 is thinner than the thick wall section 76 and is disposed distally from the thick wall section 76. As illustrated, the pyrotechnic spotter composition 74 is disposed in the cavity 72 adjacent to the thin wall section 78.

In an exemplary embodiment, the inner nose cap surface 68 of the thin wall section 78 is spatially registered with the outer nose cap surface 70 and accordingly, likewise tapers in the distal direction 22 towards the longitudinal axis 24. In an exemplary embodiment, the thin wall section 78 has a thickness of from about 0.7 mm to about 0.8 mm, for example about 0.76 mm and a length of less than about 50% of the caliber projectile diameter (e.g., diameter of the projectile body section 38) of the spotter ammunition projectile 12. Some non-limiting examples of ranges for the length include for a 20 mm projectile-about 7 to 10 mm, for a 30 mm projectile-about 10 to 15 mm, and for a 57 mm projectile-about 20 to 27 mm.

In an exemplary embodiment, the inner nose cap surface 68 of the thick wall section 76 is substantially parallel to the longitudinal axis 24. Accordingly, the cross-section of the wall 64 defined between the inner and outer nose cap surfaces 68 and 70 of the thick wall section 76 varies along a length of the longitudinal axis 24. As illustrated, the variable cross-section of the wall 64 of the thick wall section 76 flares in a proximal direction (direction opposite the distal direction 22) along a length of the longitudinal axis 24. As will be discussed in further detail below, the inner nose cap surface 68 of the thick wall section 76 is in direct contact with an outer surface of the post 56 proximal to the post distal end portion 60 to form a press fit with the post 56, which secures the ogive nose cap 62 to the projectile ogive 48.

Figure 4:
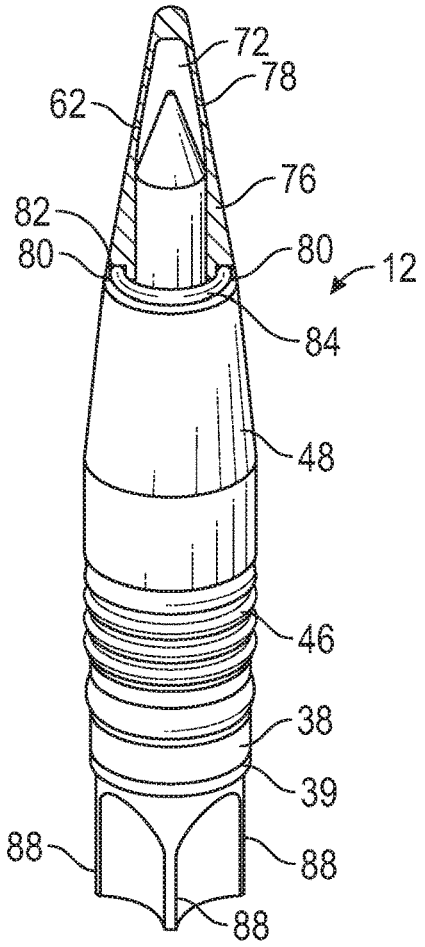
FIG. 4 illustrates a perspective tear-away view of a spotter ammunition projectile in accordance with an exemplary embodiment.

Referring also to FIG. 4, the thick wall section 76 has an annular proximal end surface 80 that extends between the inner and outer nose cap surfaces 68 and 70 at the proximal-most end of the ogive nose cap 62 that interfaces with the annular shoulder 54 of the projectile ogive 48. In an exemplary embodiment and as illustrated, the annular proximal end surface 80 defines an annular groove 82 containing an O-ring 84 that sealingly interfaces with the annular shoulder 54 and the annular proximal end surface 80 to prevent outside humidity or moisture from seeping into the cavity 72 and absorbing into the pyrotechnic spotter composition 74. Alternatively, a lacquer 86 may be disposed between and sealingly interface with the annular shoulder 54 and the annular proximal end surface 80 to prevent outside humidity or moisture from seeping into the cavity 72.

Figure 3:
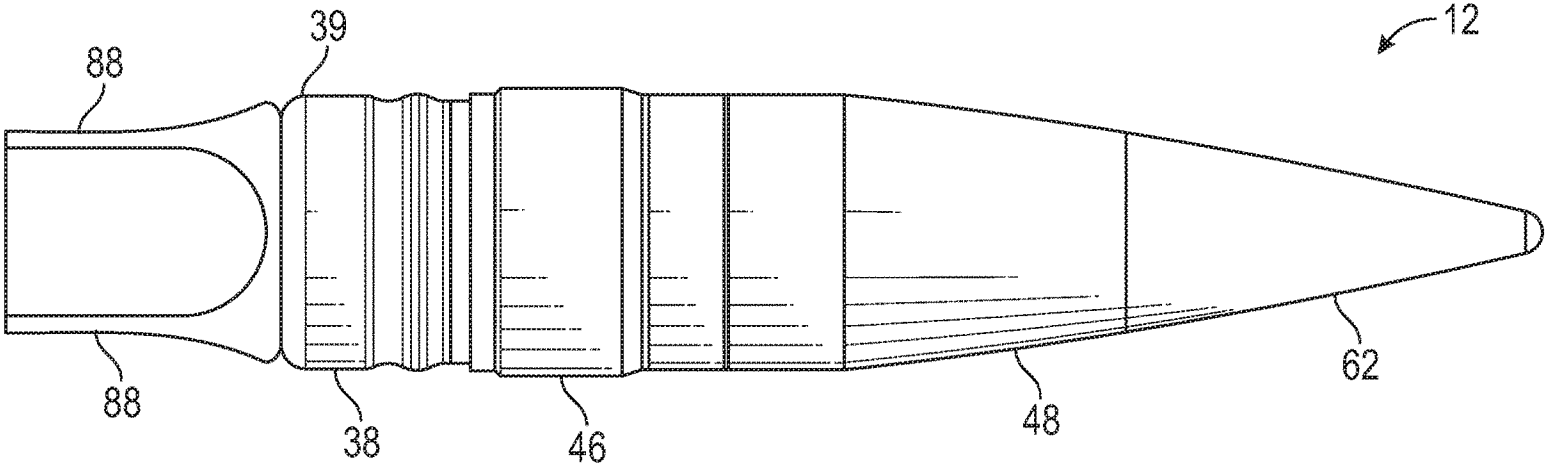
FIG. 3 illustrates a side view of a spotter ammunition projectile in accordance with an exemplary embodiment.

Referring to FIGS. 3-4, as illustrated, the spotter ammunition projectile 12 may further includes rear fins 88 that are coupled to the body proximal end portion 39 of the projectile body section 38 and extend proximally therefrom. In an exemplary embodiment, the rear fins 88 help to decelerate spin of the spotter ammunition projectile 12 into a state of instability to reduce the maximum range of the spotter ammunition projectile 12.

Figure 9:
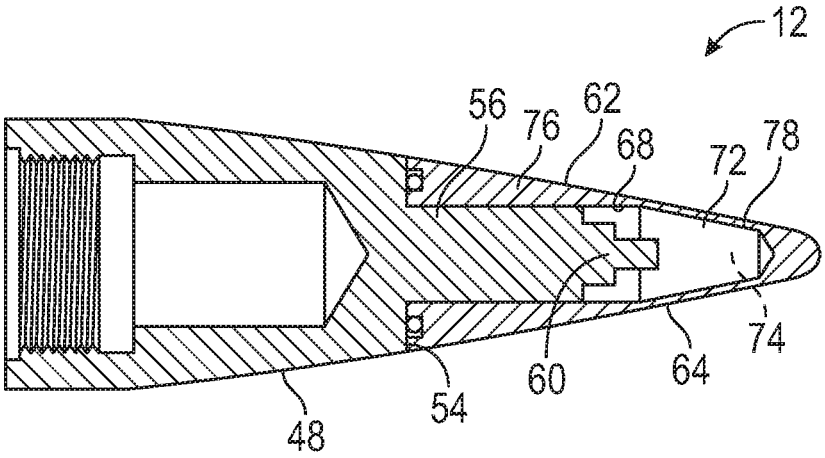
FIG. 9 illustrates a cross-sectional view of a spotter ammunition projectile in accordance with an exemplary embodiment.
Figure 10:
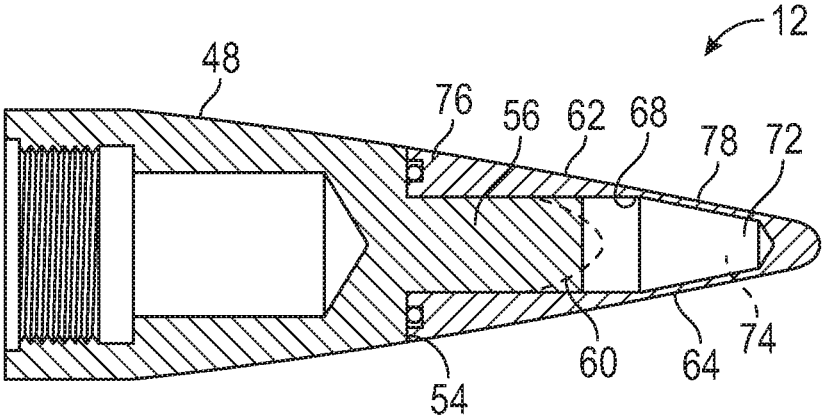
FIG. 10 illustrates a cross-sectional view of a spotter ammunition projectile in accordance with an exemplary embodiment.

Referring to FIGS. 2 and 9-10, as discussed above, the post distal end portion 60 may be configured as a conical end portion as illustrated in FIG. 2. Alternatively, the postal distal end portion 60 may be configured as a stepped distal end portion as illustrated in FIG. 9, a flat distal end portion as illustrated in FIG. 10, or a radiused distal end portion as illustrated by dashed line FIG. 10.

Figure 5:
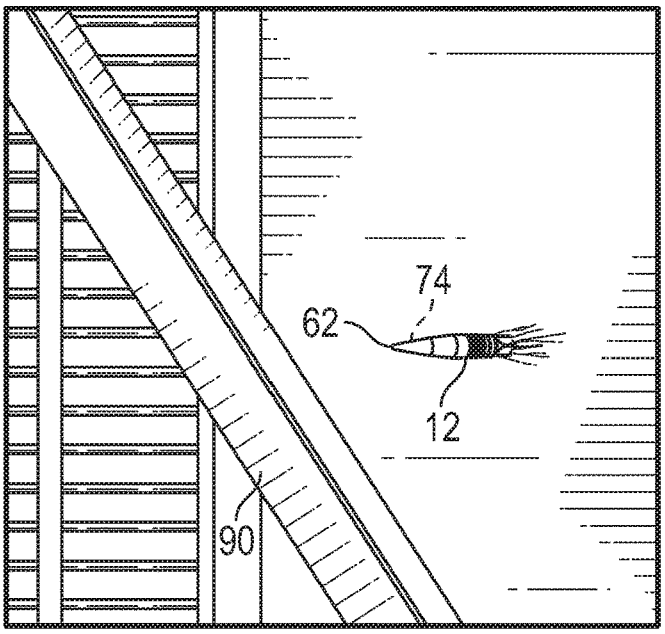
FIG. 5 illustrates a perspective side view of a spotter ammunition projectile with a rear tracer fired from a firearm prior to impacting a target in accordance with an exemplary embodiment.
Figure 6:
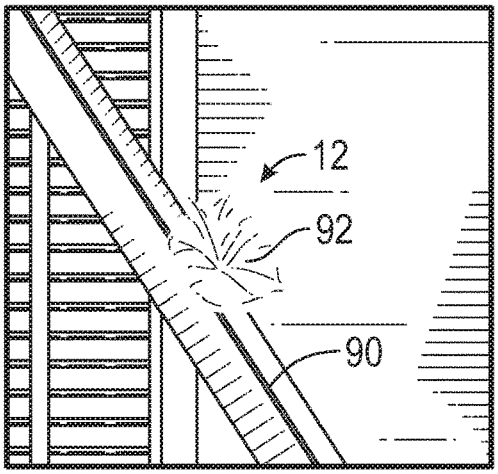
FIG. 6 illustrates a perspective side view of a spotter ammunition projectile fired from a firearm impacting a target in accordance with an exemplary embodiment.
Figure 7:
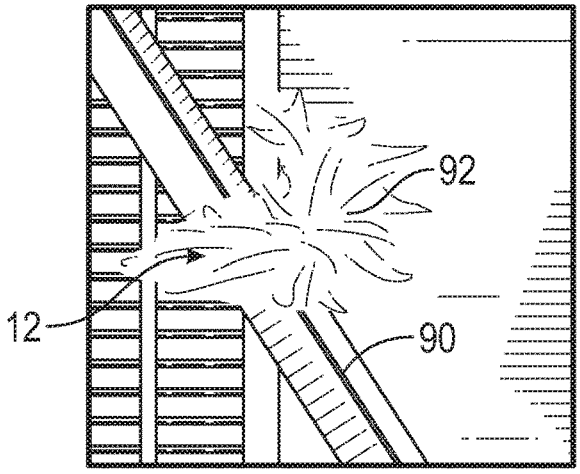
FIG. 7 illustrates a perspective side view of a spotter ammunition projectile fired from a firearm at a further advanced stage of impacting a target in accordance with an exemplary embodiment.
Figure 8:
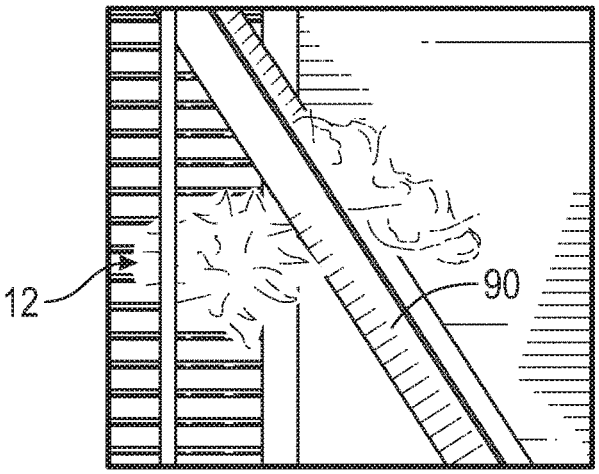
FIG. 8 illustrates a perspective side view of a spotter ammunition projectile fired from a firearm at a further advanced stage of impacting a target in accordance with an exemplary embodiment.

FIG. 5 illustrates the spotter ammunition projectile 12, with a rear tracer, prior to impacting a target 90 and FIGS. 6-8 illustrates the spotter ammunition projectile 12 during various advanced stages of impacting the target 90 in accordance with an exemplary embodiment. In an exemplary embodiment, the target 90 is a relatively thin steel plate target. As illustrated, advantageously when the spotter ammunition projectile 12 impacts the target 90, for example at a relatively high velocity of about Mach 1, the ogive nose cap 62 rapidly deforms and bursts, causing intense heating and sparking to occur and thereby reliably igniting the pyrotechnic spotter composition 74 and producing a bright light flash 92 in front of the target 90.

Figure 11:
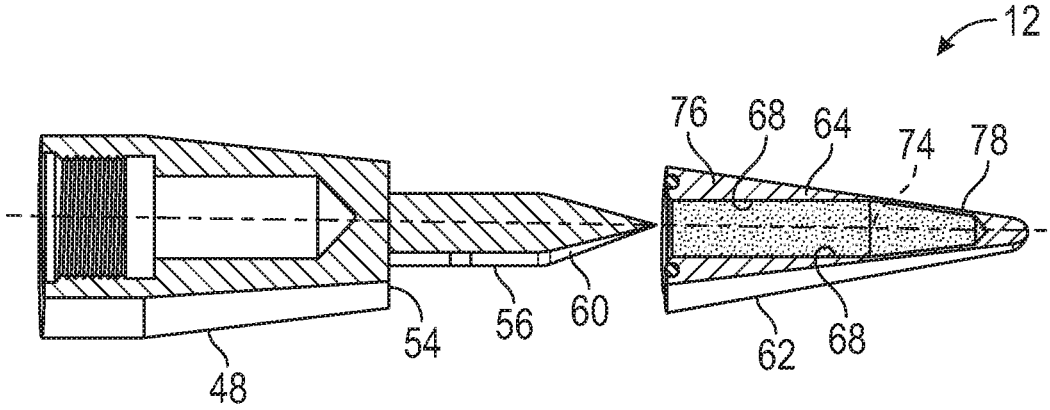
FIG. 11 illustrates a cross-sectional view of a spotter ammunition projectile during an intermediate fabrication stage in accordance with an exemplary embodiment.
Figure 12:
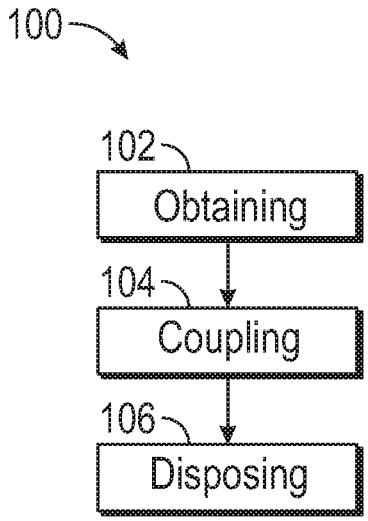
FIG. 12 illustrates a flow chart of a method for making a spotter ammunition projectile in accordance with an exemplary embodiment.

Referring to FIGS. 11-12, a method 100 for making the spotter ammunition projectile 12 is provided. The method 100 includes obtaining (STEP 102) the projectile body section 38 and the projectile ogive 48 as discussed above in relation to FIGS. 1-4 and 9-10.

The pyrotechnic spotter composition 74 is deposited (STEP 104) adjacent to the inner nose cap surface 68 of the wall 64 of the ogive nose cap 62. The ogive nose cap 62 is disposed (STEP 106) adjacent to the shoulder 54 such that the wall 64 covers the post 56 and the inner nose cap surface 68 faces towards the post 56. In an exemplary embodiment, the post 56 and the ogive nose cap 62 are cooperatively configured to define the cavity 72 therebetween and the pyrotechnic spotter composition 74 is disposed in the cavity 72.

In an exemplary embodiment, the wall 64 of the ogive nose cap 62 has the thick wall section 76. Disposing (STEP 106) includes press fitting the projectile ogive 48 and the ogive nose cap 62 together such that the inner nose cap surface 68 of the thick wall section 76 advances over and is in direct contact with an outer surface of the post 56 to form a press fit that secures the ogive nose cap 62 to the projectile ogive 48.

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing an exemplary embodiment of the disclosure. It being understood that various changes may be made in the function and arrangement of elements described in an exemplary embodiment without departing from the scope of the disclosure as set forth in the appended claims.

What is claimed is:

1. A spotter ammunition projectile adapted to be fired from a firearm, the spotter ammunition projectile comprising:

a projectile body section having a generally cylindrical shape extending in a distal direction about a longitudinal axis to a body distal end portion;

a projectile ogive coupled to the body distal end portion and having an outer ogive surface that tapers in the distal direction towards a shoulder that is disposed about the longitudinal axis, wherein the projectile ogive comprises a post disposed adjacent to the shoulder and extending therefrom along the longitudinal axis in the distal direction to a post distal end portion;

an ogive nose cap disposed adjacent to the shoulder and having a wall that extends therefrom in the distal direction covering the post, the wall having an inner nose cap surface that faces towards the post and an outer nose cap surface that is disposed on a side opposite the inner nose cap surface and that tapers in the distal direction towards the longitudinal axis, wherein the post and the ogive nose cap are cooperatively configured to define a cavity between at least a portion of the post and the inner nose cap surface; and a pyrotechnic spotter composition disposed in the cavity.

2. The spotter ammunition projectile of claim 1, wherein the cavity is disposed between the post distal end portion and the inner nose cap surface.

3. The spotter ammunition projectile of claim 2, wherein the post distal end portion is one of a conical end portion, a stepped distal end portion, a flat distal end portion, and a radiused distal end portion.

4. The spotter ammunition projectile of claim 1, wherein the wall of the ogive nose cap defines a conical-shaped nose cap that has a thick wall section and the thin wall section that is thinner than the thick wall section and that is disposed distally from the thick wall section.

5. The spotter ammunition projectile of claim 4, wherein the pyrotechnic spotter composition is disposed in the cavity adjacent to the thin wall section.

6. The spotter ammunition projectile of claim 4, wherein the inner nose cap surface of the thin wall section tapers in the distal direction towards the longitudinal axis.

7. The spotter ammunition projectile of claim 6, wherein the projectile body section has a diameter and the thin wall section has a length that is less than the diameter of the projectile body section.

8. The spotter ammunition projectile of claim 4, wherein the inner nose cap surface of the thick wall section is substantially parallel to the longitudinal axis.

9. The spotter ammunition projectile of claim 8, wherein the inner nose cap surface of the thick wall section is in direct contact with an outer surface of the post to form a press fit with the post, thereby securing the ogive nose cap to the projectile ogive.

10. The spotter ammunition projectile of claim 4, wherein the post has a post proximal end portion opposite the post distal end portion, and wherein shoulder is an annular shoulder disposed around the longitudinal axis extending radially outward from the post proximal end portion.

11. The spotter ammunition projectile of claim 10, wherein the thick wall section has an annular proximal end surface that extends between the inner nose cap surface and the outer nose cap surface and that interfaces with the annular shoulder.

12. The spotter ammunition projectile of claim 11, further comprising an O-ring that sealingly interfaces with the annular shoulder and the annular proximal end surface.

13. The spotter ammunition projectile of claim 11, further comprising lacquer that sealingly interfaces with the annular shoulder and the annular proximal end surface.

14. The spotter ammunition projectile of claim 1, wherein the ogive nose cap comprises aluminum, magnesium, or titanium.

15. The spotter ammunition projectile of claim 1, wherein the pyrotechnic spotter composition is present in the cavity in an amount of from about 0.5 g to about 1.5 g.

16. A spotter ammunition cartridge adapted to be chambered in a firearm, the spotter ammunition cartridge comprising:

a cartridge case comprising a generally cylindrical shell having a shell wall that surrounds an internal volume and that extends in a distal direction about a longitudinal axis to a case mouth portion;

a spotter ammunition projectile comprising:

a projectile body section disposed in the case mouth portion and having a generally cylindrical shape extending in the distal direction about the longitudinal axis to a body distal end portion;

a projectile ogive coupled to the body distal end portion and having an outer ogive surface that tapers in the distal direction towards a shoulder that is disposed about the longitudinal axis, wherein the projectile ogive comprises a post disposed adjacent to the shoulder and extending therefrom along the longitudinal axis in the distal direction to a post distal end portion;

an ogive nose cap disposed adjacent to the shoulder and having a wall that extends therefrom in the distal direction covering the post, the wall having an inner nose cap surface that faces towards the post and an outer nose cap surface that is disposed on a side opposite the inner nose cap surface and that tapers in the distal direction towards the longitudinal axis, wherein the post and the ogive nose cap are cooperatively configured to define a cavity between at least a portion of the post and the inner nose cap surface; and a pyrotechnic spotter composition disposed in the cavity; and a propellant disposed in the internal volume and ignitable to propel the spotter ammunition projectile from the case mouth in the distal direction.

17. The spotter ammunition cartridge of claim 16, wherein the spotter ammunition projectile is a medium caliber projectile selected from a 20 mm caliber projectile, a 25 mm caliber projectile, a 30 mm caliber projectile, a 35 mm caliber projectile, and a 40 mm caliber projectile.

18. The spotter ammunition cartridge of claim 16, wherein the spotter ammunition projectile is a large caliber projectile selected from a 57 mm caliber projectile, a 76 mm caliber projectile, a 105 mm caliber projectile, a 120 mm caliber projectile, and a 155 mm caliber projectile.

19. A method for making a spotter ammunition projectile adapted to be fired from a firearm, the method comprising the steps of:

obtaining a projectile body section and a projectile ogive, wherein the projectile body section has a generally cylindrical shape extending in a distal direction about a longitudinal axis to a body distal end portion, wherein the projectile ogive is configured to couple to a body distal end portion and has an outer ogive surface that tapers in the distal direction towards a shoulder that is disposed about the longitudinal axis, wherein the projectile ogive comprises a post disposed adjacent to the shoulder and extending therefrom along the longitudinal axis in the distal direction to a post distal end portion;

depositing a pyrotechnic spotter composition adjacent to an inner nose cap surface of a wall of an ogive nose cap; and disposing the ogive nose cap adjacent to the shoulder such that the wall covers the post and the inner nose cap surface faces towards the post, wherein the wall has an outer nose cap surface that is disposed on a side opposite the inner nose cap surface and that tapers in the distal direction towards the longitudinal axis, wherein the post and the ogive nose cap are cooperatively configured to define a cavity between at least a portion of the post and the inner nose cap surface, and wherein the pyrotechnic spotter composition is disposed in the cavity.

20. The method of claim 19, wherein the wall of the ogive nose cap has a thick wall section, and wherein disposing comprises press fitting the projectile ogive and the ogive nose cap together such that the inner nose cap surface of the thick wall section advances over and is in direct contact with an outer surface of the post to form a press fit that secures the ogive nose cap to the projectile ogive.

* * * * *